US012502018B1

(12) United States Patent
Liu

(10) Patent No.: US 12,502,018 B1
(45) Date of Patent: Dec. 23, 2025

(54) WALL-MOUNTED HAT RACK

(71) Applicant: Yun Liu, Hunan (CN)

(72) Inventor: Yun Liu, Hunan (CN)

( * ) Notice: Subject to any disclaimer, the term of this patent is extended or adjusted under 35 U.S.C. 154(b) by 0 days.

(21) Appl. No.: 19/207,419

(22) Filed: May 14, 2025

(30) Foreign Application Priority Data

Apr. 16, 2025 (CN) ..... 202520730166.2

(51) Int. Cl.
*A47G 25/10* (2006.01)
*A47F 7/06* (2006.01)

(52) U.S. Cl.
CPC ..... *A47G 25/10* (2013.01); *A47F 7/06* (2013.01)

(58) Field of Classification Search
CPC . A47G 25/10; A47B 81/00; A47F 7/06; A47F 7/19; A47F 7/24
See application file for complete search history.

(56) References Cited

U.S. PATENT DOCUMENTS 846,956 A * 3/1907 Shaw ..... A47G 25/10 211/32
973,173 A * 10/1910 Comeau et al. ..... A47G 25/10 211/32
1,585,804 A * 5/1926 Vincent ..... A47G 25/10 211/31
1,720,109 A * 7/1929 Benjamin ..... A47G 25/10 211/32
4,673,153 A * 6/1987 Hilty ..... A47F 7/06 D6/326
5,163,589 A * 11/1992 Biehl ..... D06F 59/02 223/24
5,188,325 A * 2/1993 Hilty ..... A47F 7/06 211/32
5,240,123 A * 8/1993 Hawk ..... A47F 5/0807 211/32
5,244,102 A * 9/1993 Koenig ..... A47G 25/10 211/32
5,396,994 A * 3/1995 Fitzgerald ..... A47F 5/0884 211/32
5,480,073 A * 1/1996 LaManna ..... A47F 7/06 211/32
6,223,910 B1 * 5/2001 Levin ..... A47F 7/06 211/113
6,824,027 B2 * 11/2004 Frey ..... A47F 7/06 D2/891
10,458,594 B2 10/2019 Burton
(Continued)

FOREIGN PATENT DOCUMENTS

DE 839077 C * 5/1952
DE 202017102076 U1 * 12/2017 ..... A47G 25/10

*Primary Examiner* — Stanton L Krycinski
(74) *Attorney, Agent, or Firm* — S.J. Intellectual Property LTD.

(57) ABSTRACT

A wall-mounted hat rack includes a hat rack body and a clamping component. The hat rack body has a first surface parallel to the longitudinal direction; the clamping component includes a first clamping portion and a second clamping portion, the first clamping portion and the second clamping portion are respectively arranged on the first surface, and the first clamping portion and the second clamping portion are arranged at intervals along the longitudinal direction. A groove is provided at the bottom of the first clamping portion, and the groove is used to accommodate the buckle portion of a baseball cap.

14 Claims, 5 Drawing Sheets

(56) References Cited

U.S. PATENT DOCUMENTS

| | | | | |
|---|---|---|---|---|
| 10,849,448 | B1 * | 12/2020 | Bland | A47F 7/021 |
| 11,168,853 | B2 | 11/2021 | Hsu | |
| 11,350,772 | B2 * | 6/2022 | Quezada | B60R 7/10 |
| D1,005,704 | S * | 11/2023 | Lai | D6/323 |
| 11,815,117 | B2 | 11/2023 | Osaki | |
| D1,062,259 | S * | 2/2025 | Xu | D6/326 |
| 12,220,071 | B1 * | 2/2025 | Jiang | A47F 5/0006 |
| D1,072,608 | S * | 4/2025 | Deng | D8/373 |
| 2010/0230368 | A1 * | 9/2010 | Slade | A47F 3/10 211/33 |
| 2020/0146470 | A1 * | 5/2020 | Quezada | B60R 7/10 |
| 2022/0047101 | A9 * | 2/2022 | Quezada | A47F 7/06 |
| 2023/0301451 | A1 * | 9/2023 | Park | A47G 25/10 |

* cited by examiner

WALL-MOUNTED HAT RACK

CROSS REFERENCE TO RELATED APPLICATIONS

The present application claims priority benefits of Chinese patent application NO. 2025207301662, filed on Apr. 16, 2025, the content of which is incorporated by reference in its entirety.

TECHNICAL FIELD

The present disclosure relates to commodity display racks, and in particular to a wall-mounted hat rack.

BACKGROUND

Baseball caps are a major category among various hat products. When selling baseball caps, merchants typically need to use display racks to showcase multiple different baseball caps simultaneously, allowing consumers to make selections. Commercially available baseball cap display racks usually involve fastening the buckle portion of baseball caps onto a hook, enabling them to be stacked for display.

SUMMARY

A first aspect of the present disclosure provides a wall-mounted hat rack for displaying baseball caps, including: a hat rack body having a first surface extending in a preset direction; and a clamping component including a first clamping portion and a second clamping portion, the first clamping portion and the second clamping portion being arranged on the first surface, and the first clamping portion and the second clamping portion being arranged at intervals along an extension direction of the first surface, and a bottom of the first clamping portion defining a groove configured to accommodate a buckle portion of one of the baseball caps.

A second aspect of the present disclosure provides a wall-mounted hat rack for displaying baseball caps, including: a hat rack body having a first surface extending in a preset direction; and a clamping component including a second clamping portion and a third clamping portion, the second clamping portion and the third clamping portion being arranged on the first surface, and the second clamping portion and the third clamping portion being arranged at intervals in an extension direction of the first surface.

BRIEF DESCRIPTION OF THE DRAWINGS

The drawings that form part of the present disclosure are provided to further illustrate the present disclosure. The illustrative embodiments and their descriptions of the present disclosure are intended to explain but do not constitute an undue limitation on the present disclosure.

DETAILED WAY

Figure 1:
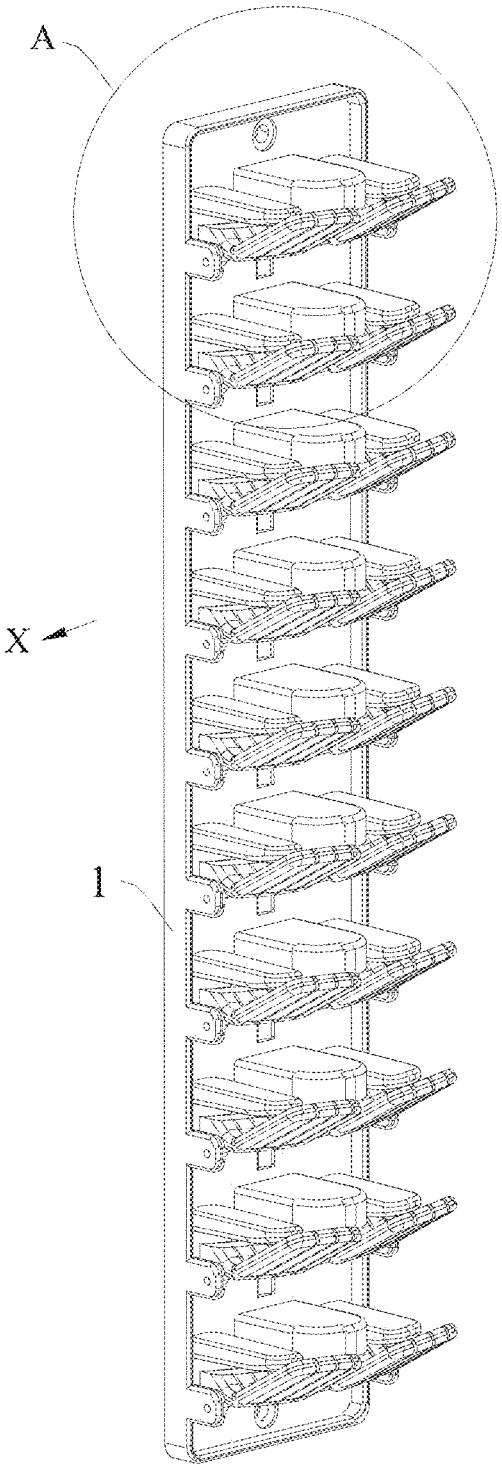
FIG. 1 is a perspective view of a wall-mounted hat rack according to some embodiments of the present disclosure.

The present disclosure is described in detail below with reference to the accompanying drawings and in conjunction with various embodiments. Each example is provided to explain but not to constitute undue limitation on the present disclosure. In fact, it is clear to those of ordinary skill that modifications and variations may be made without departing from the scope or spirit of the present disclosure. For example, a feature shown or described as a part of some embodiments may be used by some embodiments to produce yet some embodiments. Therefore, it is intended that the present disclosure includes such modifications and variations within the scope of the appended claims and their equivalents.

In the description of the present disclosure, the terms "longitudinal", "lateral", "upper", "lower", "front", "back", "left", "right", "vertical", "horizontal", "top", "bottom" and the like indicate the orientational or positional relationships based on the orientational or positional relationships illustrated in the drawings, which are only for the convenience of describing and do not require the present disclosure to be constructed and operated in a specific orientation, and therefore shall not be understood as limitation on the present disclosure. The terms "connected", "connecting" and "disposed" used in the present disclosure should be understood in a broad sense. For example, it may be a fixed connection or a detachable connection; it may be directly connected or indirectly connected through an intermediate component; it may also be a wired electrical connection, a radio connection, or a wireless signal connection. For those of ordinary skill in the art, the specific meanings of the above terms may be understood according to the specific circumstances.

One or more examples of the present disclosure are illustrated in the attached drawings. Characters and letters are used in the detailed description to refer to features in the drawings. Similar signs in the drawings and descriptions have been configured to refer to similar parts of the present disclosure. As used herein, the terms "first", "second" and "third" are used interchangeably to distinguish one component from another and are not intended to indicate the position or importance of each component.

During this display process, as multiple baseball caps are simultaneously hung on the hook, users find it inconvenient to remove an individual cap from the hook. Additionally, the stacking of multiple caps easily causes deformation due to pressure.

Therefore, how to enable users to taking an individual baseball cap more conveniently while preventing deformation under pressure during display remains a technical problem that urgently needs to be addressed.

Figure 2:
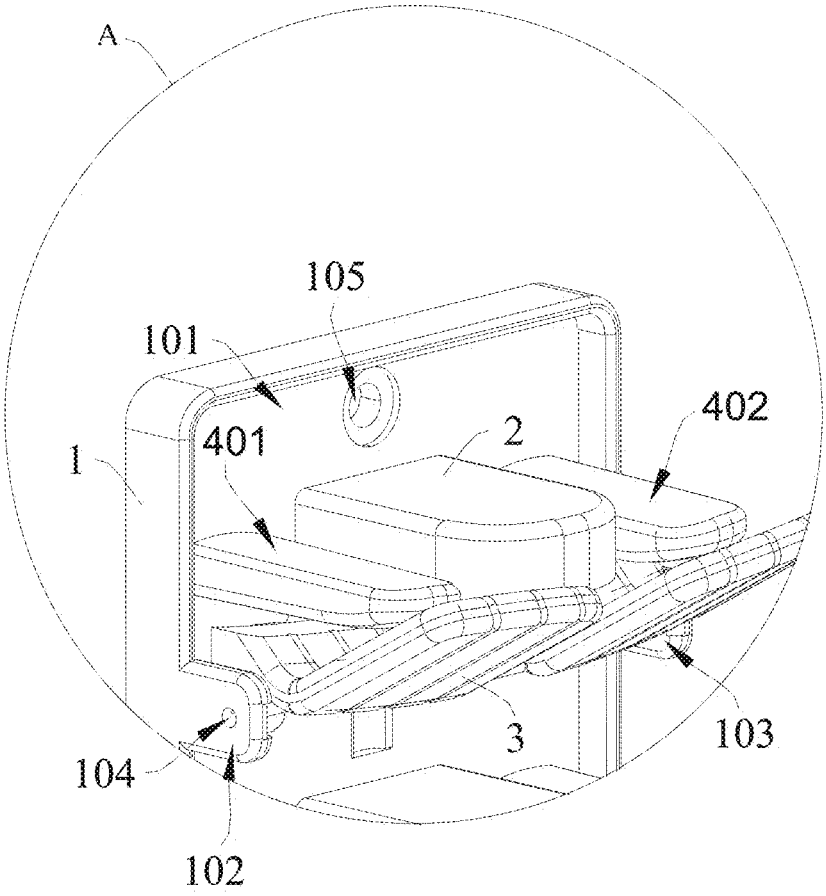
FIG. 2 is a partial enlarged view of area A in FIG. 1.
Figure 3:
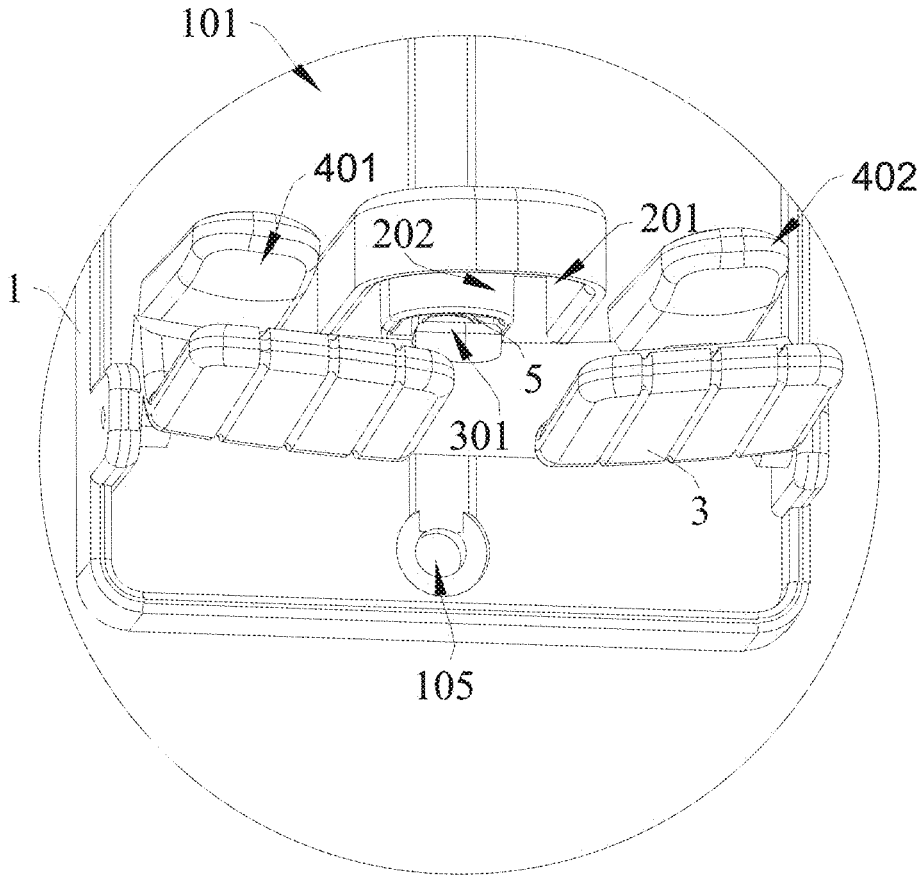
FIG. 3 is a perspective view of a portion of a wall-mounted hat rack according to some embodiments of the present disclosure.
Figure 4:
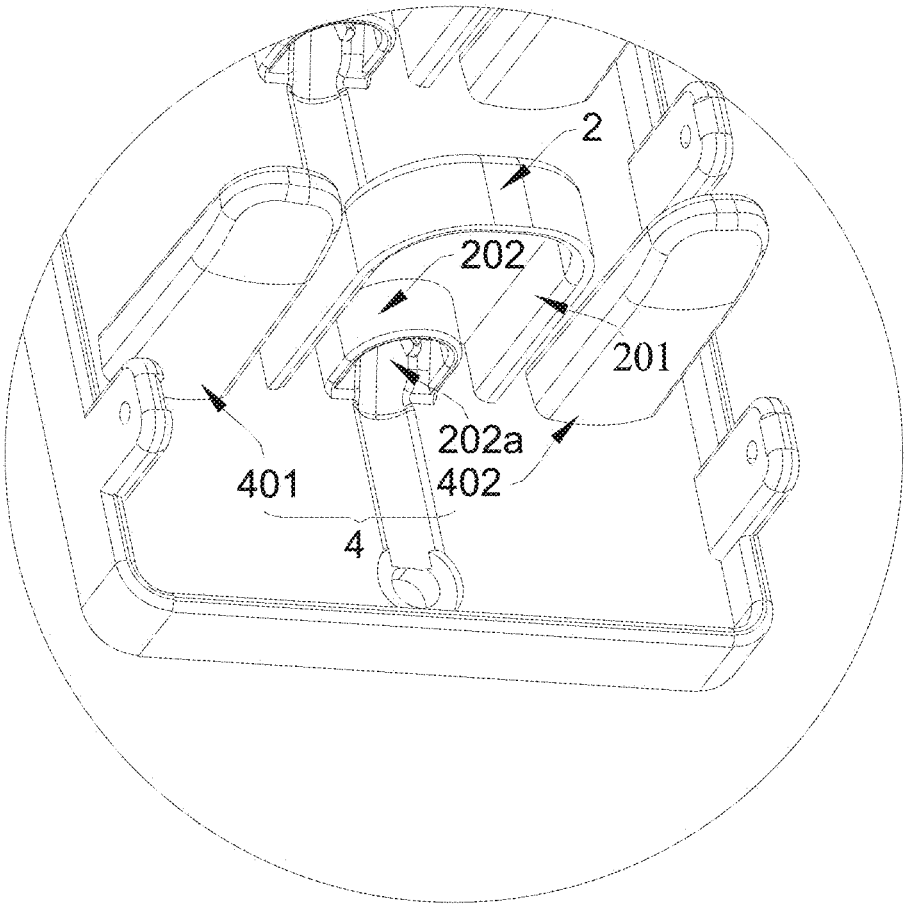
FIG. 4 is a perspective view of a hat rack body of a wall-mounted hat rack according to some embodiments of the present disclosure.
Figure 5:
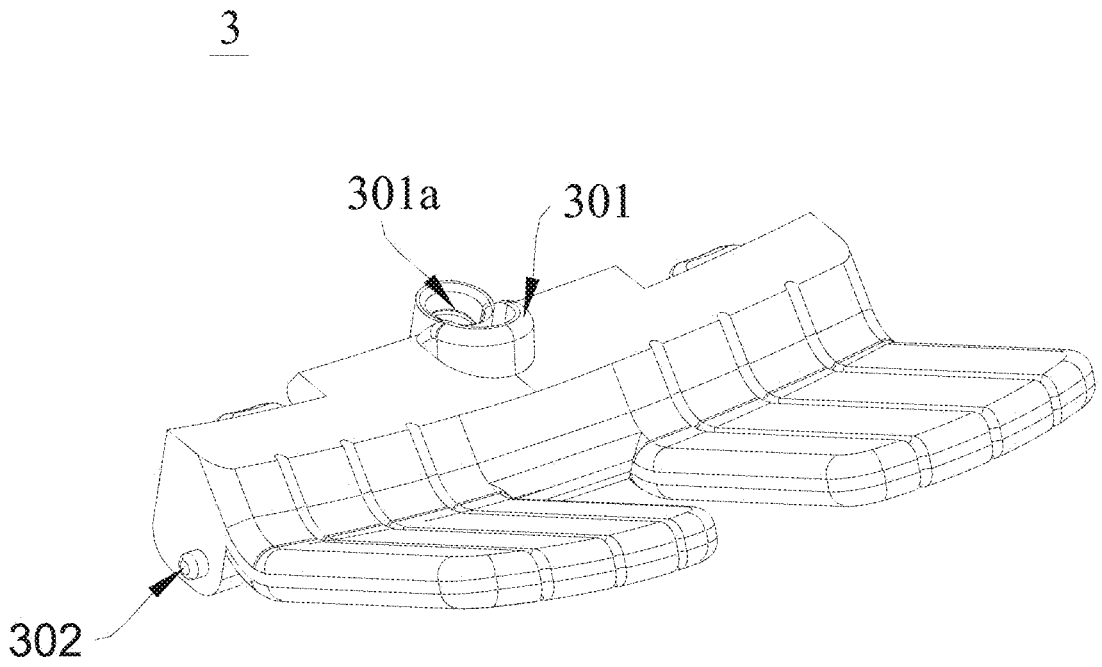
FIG. 5 is a perspective view of a second clamping portion of a wall-mounted hat rack according to some embodiments of the present disclosure.

As shown in FIG. 1 to FIG. 5, according to some embodiments of the present disclosure, a wall-mounted hat rack is provided. The wall-mounted hat rack includes a hat rack body 1 and a plurality of clamping components. The hat rack body 1 includes a longitudinal first surface 101. The plurality of clamping components are arranged on the first surface 101 at intervals along the longitudinal direction. Each clamping component includes a first clamping portion 2, a second clamping portion 3 and a third clamping portion 4.

In some embodiments, as shown in FIG. 1 to FIG. 5, a bottom of the first clamping portion 2 is defined with a groove 201, and a shape and size of the groove 201 match a buckle portion of a baseball cap to allow the groove 201 to accommodate the buckle portion.

In some embodiments, as shown in FIG. 1 to FIG. 5, the second clamping portion 3 is spaced apart from the first clamping portion 2 along the longitudinal direction. The second clamping portion 3 includes two L-shaped pressing plates spaced apart along a first direction X. The two L-shaped pressing plates are configured to fit with an inner surface of the baseball cap. When the baseball cap is hung by the wall-mounted hat rack, the two L-shaped pressing plates are pressed against the inner surface of the baseball cap, and the groove 201 at the bottom of the first clamping portion 2 fastens the buckle portion of the baseball cap. In this manner, the clamping component to clamps the baseball cap, thus preventing the baseball cap from falling.

In some embodiments, as shown in FIG. 1 to FIG. 5, the third clamping portion 4 includes a first pressing member 401 and a second pressing member 402 arranged at intervals along the first direction X. The first clamping portion 2 is located between the first pressing member 401 and the second pressing member 402. When the baseball cap is hung on the clamping component, the first pressing member 401 and the second pressing member 402 of the third clamping portion 4 simultaneously press a top surface of the baseball cap, thereby further increasing the clamping tightness of the baseball cap by the wall-mounted hat rack.

In some embodiments, as shown in FIG. 1 to FIG. 5, each clamping component is correspondingly provided with a first connection portion 102 and a second connection portion 103. The first connection portion 102 and the second connection portion 103 are respectively provided on the first surface 101 of the hat rack body 1. The first connection portion 102 and the second connection portion 103 are spaced apart along the first direction X. Each second clamping portion 3 is provided between its corresponding first connection portion 102 and the second connection portion 103. Each of two ends of each second clamping portion 3 includes a rotating shaft 302 in the first direction X. Each first connection portion 102 and each second connection portion 103 is defined with a connecting hole 104, allowing each second clamping portion 3 to be rotatably connected to its corresponding first connection portion 102 and second connection portion 103 through the connecting hole 104. A user can apply a downward force along the longitudinal direction to the second clamping portion 3, such that the second clamping portion 3 rotates relative to the hat rack body 1 around its rotating shaft, allowing the user to put the baseball cap into the clamping component.

In some embodiments, as shown in FIG. 1 to FIG. 5, a bottom of the first clamping portion 2 is also provided with a first abutting portion 202 defining a first slot 202*a*, and a second abutting portion 301 defining a second slot 301*a* is provided on a top of the second clamping portion 3 and corresponds to the position of the first abutting portion 202. A spring 5, i.e., an elastic member, is provided between the first abutting portion 202 and the second abutting portion 301. Two ends of the spring 5 in the longitudinal direction respectively abut against the first slot 202*a* in the first abutting portion 202 and the second slot 301*a* in the second abutting portion 301. When the user applies an external force to rotate the second clamping portion 3, the spring 5 stretches, and the user can put the baseball cap into the clamping component. When the user releases the second clamping portion 3, the external force disappears to allow the spring 5 to rebound, the second clamping portion 3 automatically rotates under the action of the spring 5. In this way, the second clamping portion 3 and cooperates with the first clamping portion 2 and the third clamping portion 4 to clamp the baseball cap.

In some embodiments, as shown in FIG. 1 to FIG. 5, the hat rack body 1 is defined with a mounting hole 105, and a user can install the wall-mounted hat rack on a storage surface through the mounting hole 105.

From the above description, it can be seen that the above-mentioned embodiments of the present disclosure achieve the following technical effects.

When the wall-mounted hat rack is in use, the user can apply an external force to rotate the second clamping portion 3 relative to the hat rack body 1, thereby placing the baseball cap in the clamping component. When the user releases the second clamping portion 3, the external force disappears, the spring 5 rebounds, and the second clamping portion 3 automatically rotates under the action of the spring 5. Then, the second clamping portion 3 presses the inner surface of the baseball cap, the groove 201 at the bottom of the first clamping portion 2 buckles the hat buckle portion of the baseball cap, and the first pressing member 401 and the second pressing member 402 of the third clamping portion respectively press the top surface of the baseball cap, thereby ensuring that the clamping component can clamp the baseball cap. When the user needs to take off the baseball cap, he/she only needs to apply external force to rotate the second clamping portion 3 relative to the hat rack body 1 to take out the baseball cap.

Compared with the related art, in the wall-mounted hat rack proposed in this application, each clamping component clamps a baseball cap, which can ensure that the user can clamp or take out each baseball cap more conveniently. The independent clamping component can also avoid the deformation of baseball caps caused by stacking multiple baseball caps.

The above description only illustrates some embodiments of the present disclosure, and does not limit the protection scope of the present disclosure. All equivalent structural changes made by using the contents in the specification and drawings under the concept of the present disclosure, or directly/indirectly used in other related technical fields are included in the protection scope of the present disclosure.

The invention claimed is:

1. A wall-mounted hat rack for displaying baseball caps, comprising:

a hat rack body having a first surface extending in a preset direction; and a clamping component comprising a first clamping portion and a second clamping portion, the first clamping portion and the second clamping portion being arranged on the first surface, and the first clamping portion and the second clamping portion being arranged at intervals along an extension direction of the first surface, and a bottom of the first clamping portion defining a groove configured to accommodate a buckle portion of one of the baseball caps;

wherein a first abutting portion is further provided on a side, facing the second clamping portion, of the first clamping portion; a second abutting portion is provided on a top, corresponding to the first abutting portion, of the second clamping portion; the clamping component further comprises an elastic member, and two ends of the elastic member respectively abut against the first abutting portion and the second abutting portion.

2. The wall-mounted hat rack according to claim 1, wherein a first connecting portion and a second connecting portion are arranged on the first surface, the first connecting portion and the second connecting portion are arranged at intervals along a first direction, and two ends of the second clamping portion in the first direction are rotatably connected to the first connecting portion and the second connecting portion respectively, the first direction is perpendicular to the extension direction of the first surface and parallel to the first surface.

3. The wall-mounted hat rack according to claim 1, wherein a quantity of the clamping component is at least two, and the at least two clamping components are arranged at intervals in a longitudinal direction of the first surface.

4. A wall-mounted hat rack for displaying baseball caps, comprising:

a hat rack body having a first surface extending in a preset direction; and a clamping component comprising a clamping plate and a clamping portion, the clamping plate and the clamping portion being arranged on the first surface, and the clamping plate and the clamping portion being arranged at intervals in an extension direction of the first surface;

wherein the clamping portion comprises a first pressing member and a second pressing member, the first pressing member and the second pressing member are arranged at intervals along a first direction; and a first abutting portion is provided between the first pressing member and the second pressing member; a second abutting portion is provided on a top, corresponding to the first abutting portion, of the clamping plate; the clamping component further comprises an elastic member, and two ends of the elastic member are respectively abutted against the first abutting portion and the second abutting portion.

5. The wall-mounted hat rack according to claim 4, wherein the first direction is perpendicular to the extension direction of the first surface and parallel to the first surface.

6. The wall-mounted hat rack according to claim 5, wherein the first surface is provided with a first connection portion and a second connection portion, and the first connection portion and the second connection portion are arranged at intervals along the first direction, and two ends of the clamping plate in the first direction are rotatably connected to the first connection portion and the second connection portion respectively.

7. The wall-mounted hat rack according to claim 5, wherein a quantity of the clamping component is at least two, and the at least two clamping components are arranged at intervals along a longitudinal direction of the first surface.

8. The wall-mounted hat rack according to claim 1, further comprising:

a third clamping portion, the third clamping portion comprising a first pressing member and a second pressing member arranged at intervals, the first clamping portion being arranged between the first pressing member and the second pressing member.

9. The wall-mounted hat rack according to claim 1, wherein the second clamping portion comprises two L-shaped pressing plates spaced apart along a first direction.

10. The wall-mounted hat rack according to claim 1, wherein the first abutting portion defines a first slot, the second abutting portion defines a second slot, and the two ends of the spring respectively abut against the first slot and the second slot.

11. The wall-mounted hat rack according to claim 1, wherein the hat rack body is defined with a mounting hole.

12. The wall-mounted hat rack according to claim 4, wherein the clamping plate comprises two L-shaped pressing plates spaced apart along a first direction.

13. The wall-mounted hat rack according to claim 4, wherein the first abutting portion defines a first slot, the second abutting portion defines a second slot, and the two ends of the spring respectively abut against the first slot and the second slot.

14. The wall-mounted hat rack according to claim 4, wherein the hat rack body is defined with a mounting hole.

* * * * *